United States Patent [19]

Elms et al.

[11] 4,162,429

[45] Jul. 24, 1979

[54] BALLAST CIRCUIT FOR ACCURATELY REGULATING HID LAMP WATTAGE

[75] Inventors: Robert T. Elms; Joseph C. Engel, both of Monroeville, Pa.

[73] Assignee: Westinghouse Electric Corp., Pittsburgh, Pa.

[21] Appl. No.: 920,581

[22] Filed: Jun. 29, 1978

Related U.S. Application Data

[63] Continuation-in-part of Ser. No. 776,804, Mar. 11, 1977, abandoned.

[51] Int. Cl.[2] ..... H05B 41/36

[52] U.S. Cl. ..... 315/284; 315/308; 315/311; 315/DIG. 5

[58] Field of Search ..... 315/194, 199, 283, 284, 315/291, 307, 308, 311, DIG. 4, DIG. 5

[56] References Cited

U.S. PATENT DOCUMENTS

| | | | |
|---|---|---|---|
| 3,590,316 | 6/1971 | Engel et al. | 315/308 X |
| 3,873,910 | 3/1975 | Willis, Jr. | 315/194 X |
| 3,886,405 | 5/1975 | Kubo | 315/283 X |
| 4,037,148 | 7/1977 | Owens et al. | 315/194 X |
| 4,072,878 | 2/1978 | Engel et al. | 315/205 |

*Primary Examiner*—Eugene R. LaRoche
*Attorney, Agent, or Firm*—W. D. Palmer

[57] ABSTRACT

Circuit for regulating the wattage drawn by a high-intensity-discharge (HID) lamp and for limiting the line current drawn by the lamp during starting to less than the line current drawn during normal lamp operation. The circuit includes a lamp current controlling means which has two operating modes, a first of which passes a less-than-nominal current to the lamp and a second of which passes a greater-than-nominal current to the lamp, with the ratio of the current of the second mode to the current of the first mode being less than 2:1. The lamp voltage is sensed and the line voltage also is sensed and these parameters are converted into separate current signals which are fed into a ramp capacitor to control the charging rate thereof. When the ramp capacitor achieves a predetermined level of charge during each half cycle of energizing potential, an AC switch is gated to shift the current controlling means from the first mode to the second mode. During lamp starting when the voltage drop thereacross is relatively low, the current controlling means remains in the first mode for at least the substantial portion of each half cycle of energizing potential, and after the lamp is normally operating, the ramp capacitor control, coupled with the low ratio of relative currents passed by the current controlling means, provides for an accurate control of lamp wattage and excellent overall performance.

4 Claims, 4 Drawing Figures

A
B
C
D
E
F
G
H
I
II
III
IV
V
VI
C11
R319
R318
Q302
Z3
D5
R315
R316
D6
C10
R317
R314
C9
VSS
RESET
CLOCK
VDD
IC2
R320
C8
R313
R312
IC1
CHIP-SODIUM BALLAST
CONTROL AND DIMMER
C7
C6
D4
R311
Z2
C5
C4
Z1
D3
R308
R309
R310
C3
D2
D7
R305
R304
R306
R307
Q301
R303
C2
R321
R301
C12
R302
C1

BALLAST CIRCUIT FOR ACCURATELY REGULATING HID LAMP WATTAGE

This application is a continuation-in-part of application Ser. No. 776,804 filed Mar. 11, 1977 by Joseph C. Engel and Robert T. Elms, the present applicants, and owned by the present assignee, now abandoned.

CROSS-REFERENCE TO RELATED APPLICATION

In copending application, Ser. No. 920,291, filed concurrently herewith, and owned by the present assignee, is disclosed a variable inductance ballast apparatus for an HID lamp which comprises a laminated E-I core having non-magnetic gaps intermediate the E-conformed and I-conformed members. A main winding is carried on the leg of the E-conformed member to provide two closed magnetic paths, and a control winding is wrapped about another of the legs and encircles only one of the magnetic paths. When the control winding is closed, the resulting counter MMF decreases the inductance of the ballast apparatus by a predetermined amount. Such a variable inductance ballast is particularly adapted for use with a control circuit as described herein.

In copending application Ser. No. 861,591, filed Dec. 19, 1977 by Joseph C. Engel, and owned by the present assignee, is disclosed an illumination system which automatically dims the lamps after a fixed time period of operation at rated power input.

In copending application Ser. No. 861,587, filed Dec. 19, 1977 by Robert T. Elms, and owned by the present assignee, is disclosed an illumination system which operates lamps with a high degree of illumination during the early part of the night and automatically dims the lamps during the later part of the night when a lower degree of illumination can be tolerated. The relative period of time the lamps are operated at the higher and lower levels of illumination is automatically adjusted according to the day-night seasonal variations.

In copending application Ser. No. 776,804, filed Mar. 11, 1977, now abandoned, by Joseph C. Engel and Robert T. Elms, the present applicants, and owned by the present assignee, is disclosed a ballast apparatus which accurately compensates for variations in line voltage and lamp voltage wherein the lamp voltage sensing means consist of electrical circuit components which are actuated only by electrical signals.

BACKGROUND OF THE INVENTION

This invention relates to ballast circuits for HID lamps and, more particularly, to a ballast circuit which very accurately regulates the wattage of HID lamps, and particularly high-pressure sodium lamps, during prolonged operation thereof and which also limits the line current drawn by the lamp during starting to less than the line current drawn by the lamp during normal operation.

U.S. Pat. No. 3,873,910 dated Mar. 25, 1975 to Willis, Jr., discloses a variable inductor which includes a main winding and a control winding positioned on opposite sides of a gapped shunt. The control winding is adapted to be closed by a gate-actuated AC switch, and upon closing, the inductance of the variable inductor is decreased by a predetermined amount, thereby controlling the power input to the ballasted lamp.

In U.S. Pat. No. 4,037,148 dated July 19, 1977 to Owens, is disclosed a ballast device especially adapted to operate with a variable inductor as described in the foregoing U.S. Pat. No. 3,873,910 to ballast a high-pressure sodium discharge lamp wherein a non-linear amplifier is incorporated in circuit. For actual control, lamp voltage and line voltage are sensed and these voltage signals are combined in a programmable unijunction transistor to control the firing time thereof, and thus the actuation of the gate-controlled AC switch.

U.S. Pat. No. 3,886,405 dated May 27, 1975 to Kubo discloses sensing a variety of parameters in order to effect lamp control, including sensing both lamp voltage and line voltage to vary the impedance in circuit with the lamp and thus regulate lamp power consumption. In the case line voltage is sensed, the sensed voltage is applied to a unijunction transistor to control the firing time thereof, as in the afore-mentioned U.S. Pat. No. 4,037,148.

In U.S. Pat. No. 3,590,316 dated June 29, 1971, to Engel and Elms, the applicants herein, is disclosed a transistorized wattmeter which is used to control a variable impedance in order to control lamp wattage. The wattage is measured electronically and is converted into a current signal which is used to charge a ramp-type capacitor which in turn controls the firing of a gate-controlled AC switch when a predetermined voltage is achieved across the capacitor.

Lamp starter circuits for high-pressure sodium lamps are well known such as described in U.S. Pat. No. 4,072,878 dated Feb. 7, 1978 to J. C. Engel and G. F. Saletta.

SUMMARY OF THE INVENTION

There is provided an operating circuit for controlling at about a predetermined nominal rated value the wattage drawn by an HID lamp during normal operation thereof and for limiting the line current drawn by the lamp during starting thereof to less than the line current drawn by the lamp during normal operation thereof. The lamp has the usual terminals and a nominal rated operating voltage and current. The circuit comprises the following elements:

Input terminals are adapted to be connected to an AC line voltage source having a predetermined nominal rating and output terminals are adapted to be connected to the lamp terminals, with a conventional power factor capacitor of predetermined rating desirably connected in circuit therewith.

A current controlling means is included in circuit intermediate the input terminals and the output terminals, and the current controlling means has a first operating mode in which a current less than the lamp nominal operating current is passed to the output terminals and through the lamp as connected thereacross. The current controlling means also has a second operating mode in which a current greater than the lamp nominal operating current is passed to the output terminals and through the lamp as connected thereacross. The ratio of the magnitude of the current passed to the output terminals in the second mode to the magnitude of current passed to the output terminals in the first mode is less than 2:1.

A switch is operable to switch the current controlling means between the two operating modes thereof during each half cycle of the AC line voltage and the switch comprises a gate-controlled AC switch together with a ramp capacitor of predetermined rating in circuit with the gate of the AC switch and operable to effect the gating of the switch when a predetermined voltage signal is developed across the ramp capacitor.

A line voltage sensing means measures the magnitude of the AC line voltage and generates a first current signal, the magnitude of which is indicative of the deviation of line voltage from nominal, with the first current signal feeding into the ramp capacitor during each half cycle of AC line voltage.

A lamp voltage sensing means measures the voltage drop across the lamp both during startup when the voltage drop thereacross is relatively small and also during normal lamp operation and there is generated a second current signal, the magnitude of which is indicative of the deviation of operating lamp voltage from nominal, with the second current signal also feeding into the ramp capacitor during each half cycle of AC line voltage.

Means are provided to discharge the ramp capacitor to a predetermined potential at a predetermined time in each half cycle of the AC line voltage and the ramp capacitor is thereafter charged in the same half cycle, with the time interval, in each half cycle of the AC line voltage which is required to develop the AC switch gating signal being determined by the cumulative charge delivered to the capacitor by the first current signal and the second current signal.

During startup of the lamp, the second current signal which corresponds to lamp voltage has a minimal value due to the low voltage drop across the lamp and this provides at most only a slow voltage variation in the charge on the ramp capacitor which maintains the current controlling means in the first operating mode for at least a substantial portion of each half cycle of the AC line voltage. After the lamp is normally operating with approximately nominal voltage drop thereacross, the predetermined capacitance of the ramp capacitor coupled with the cumulative charge delivered thereto by the first current signal and the second current signal coupled with the relatively small ratio of current passed by the current controlling means in the second mode to current passed by the current controlling means in the first mode providing a stable and accurate control of wattage drawn by the normally operating lamp.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
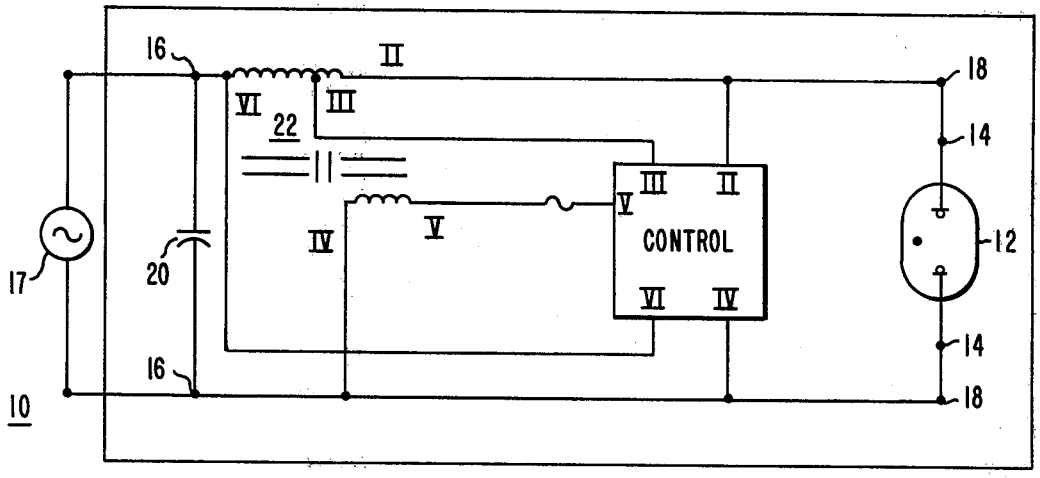
FIG. 1 is a connection diagram of the present operating ballast circuit.

With reference to the schematic circuit shown in FIG. 1, this comprises an operating circuit 10 for controlling at about a predetermined nominal rated value the wattage drawn by a high-intensity-discharge lamp means 12 during normal operation thereof and for limiting the line current drawn by the lamp means during starting thereof to less than the line current drawn by said lamp means during normal operation thereof. The lamp 12 has terminals 14 and a nominal rated operating voltage and current. As a specific example, the lamp is a high-pressure sodium lamp having a nominal rating of 250 watts, a nominal rated voltage of 100 volts, and a nominal current of 3.0 amperes. The circuit 10 comprises input terminals 16 adapted to be connected to an AC line voltage source 17 having a predetermined nominal rating such as 240 VAC., and output terminals 18 are adapted to be connected to the lamp terminals. A power-factor capacitor means 20 rated at 330 VAC, 29.2 $\mu$f desirably is connected in circuit therewith although the capacitor 20 can be omitted, if desired.

Figure 2:
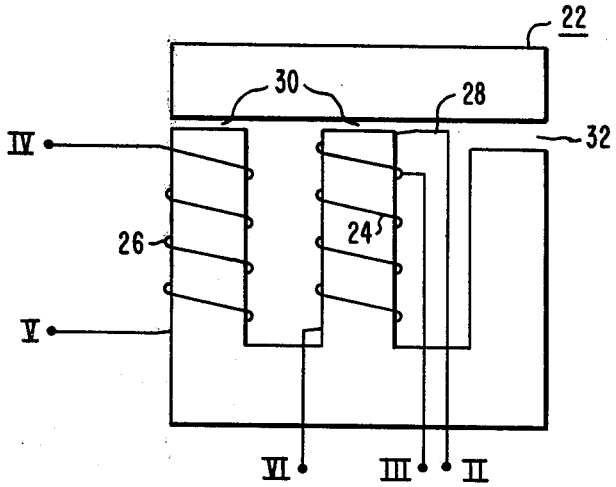
FIG. 2 is a simplified diagrammatic sketch of the preferred variable inductor used as a part of the present apparatus.

A current controlling means 22 is connected in circuit intermediate the input terminals 16 and the output terminals 18, and the current controlling means has a first operating mode in which a current less than the lamp nominal operating circuit is passed to the output terminals and through the lamp as connected thereacross, and the current controlling means also has a second operating mode in which a current greater than the lamp nominal operating current is passed to the output terminals and through the lamp as connected thereacross. In accordance with the present invention, the ratio of the magnitude of current passed to the output terminals and through the lamp in the second mode to the magnitude of current passed to the output terminals and the lamp in the first mode is less than 2:1, for reasons explained hereinafter. A preferred current controlling means is shown in FIG. 2 and this constitutes a variable reactor 22 as described in detail in the aforementioned copending application Ser. No. 920,291, filed concurrently herewith. The current controlling means thus comprises a variable reactor wherein the connections II and VI are for the main winding 24, the connections IV and V are for the control winding 26, and the connections II and III are for the starting winding 28. As a specific example, the gaps 30 are each 889 microns and the gap 32 is 4.064 mm. The connection points II–VI are shown in each of FIGS. 1, 2 and 3. With the control winding open, for a 240 volt line, the reactor 22 will pass a current of 2.6 amperes to the connected lamp and with the control winding shorted, the reactor will pass a current of 4.6 amperes to the connected lamp.

Figure 3:
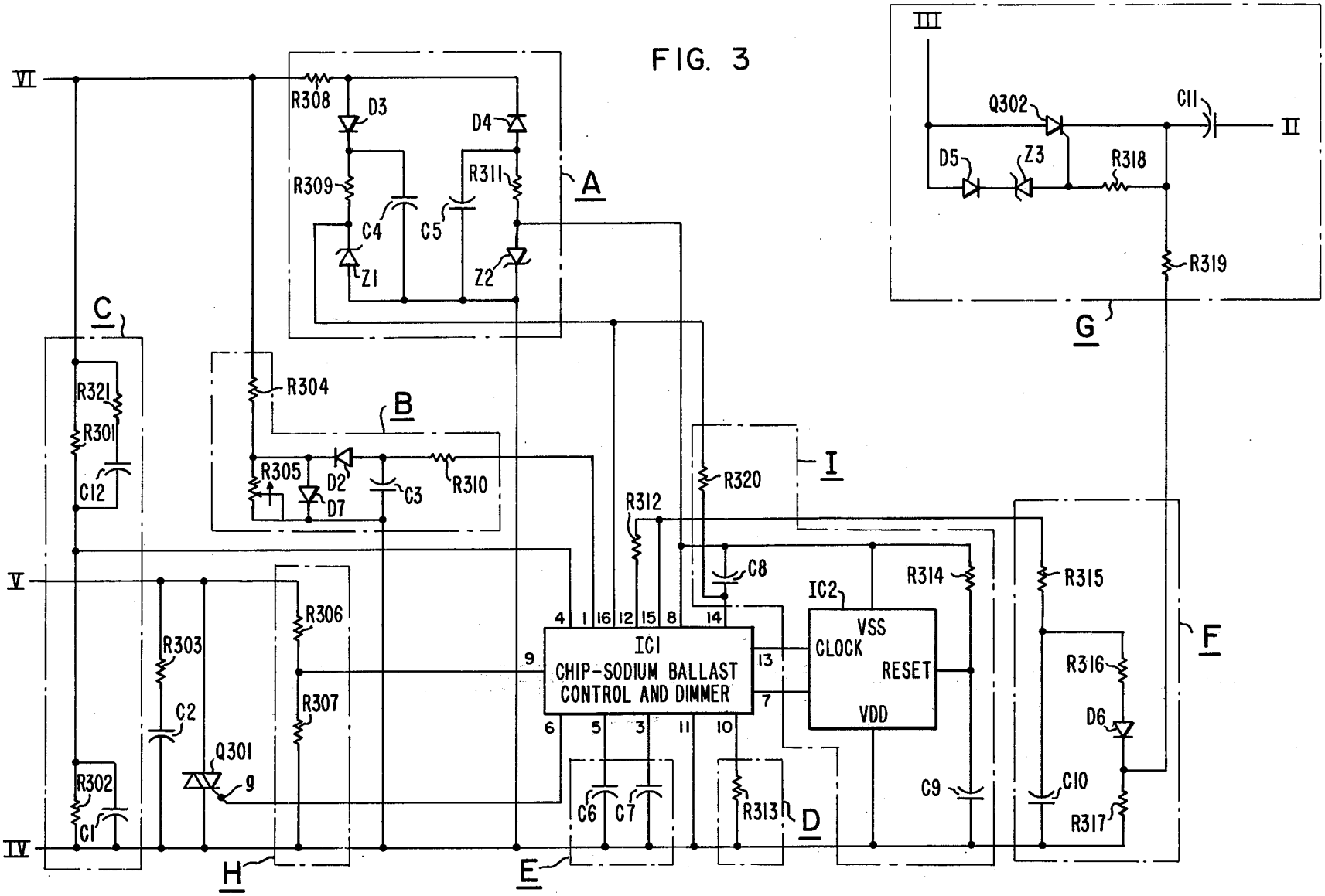
FIG. 3 is a circuit diagram of a portion of the control device with integrated circuit chips shown therein in block form.

In FIG. 3 is shown a circuit diagram of the basic control unit, with the integrated circuits or IC chips shown therein in block form, with numbered pins shown on IC1. For purposes of a description, the circuit will be broken down into the various functions which are performed, with each portion identified by an appropriate letter designation.

Power Supply—A

The power supply comprises two half wave diode rectifiers in order to produce a plus and a minus power supply. The current is generated through R308 and directed through the diode D3 for the positive power and through the diode D4 for the negative power supply. C4 and C5 filter these rectified currents to produce the DC voltages, with resistors R309 and R311 and Zeners Z1 and Z2 providing the voltage regulation.

Line Voltage Sensing—B

R304 and R305 provide a voltage divider and the divided voltage is peak rectified by D2 and filtered by C3 and R310 to provide a current which is proportional to line voltage, less a reference voltage, which current is fed into the integrated circuit chip at pin 1.

Line Voltage Zero Reset—C

Component R301, R302, R321, C1 and C12 are an R-C phase shifting network. This produces a very slight phase shift in order to provide a voltage which slightly leads the line voltage for purposes of reset. Essentially the resistors and capacitors of this circuit portion merely provide a slight RC phase shift, with the voltage input being applied to the integrated circuit at pin 4.

Bias and Reference Currents—D

The resistor R313 provides both bias and reference currents to the IC chip. The current through R313 also constitutes what amounts to a reference current which is used for control.

Energy Storage For Gate Pulse And Half Cycle Timing—E

Pin 5 on the IC chip is charged negatively with respect to ground to approximately the negative power supply level. When it is desired to gate the AC switch, Q301, all of the energy stored in C6 is discharged through pin 6 to the gate terminal "g" of triac Q301. This discharge occurs in less than approximately 10 mircroseconds. R303 and C2 which parallel Q301 provide for positive operation of the triac.

The timing of the discharge of C6 is accomplished by C7 which is charged through pin 3 by IC chip current sources, and when the charge on C7 reaches approximately 7 volts, the AC switch Q301 is triggered. C7 thus constitutes the ramp charging capacitor which provides the very large phase shifts in the triggering of the AC switch which the present ballast provides.

Lamp Voltage Sensing—F

The voltage drop across R317 is related to peak lamp voltage and this is peak-detected through D6-R316 and stored in C10. The voltage is then converted to a current through R315 and divided through pins 12 and 15. Pin 12 is effective during lamp startup and works through the chip (IC1) to minimize the time that the AC switch Q301 is on during lamp warmup, and after the lamp is normally operating the current input to pin 15 is primarily effective to control the operation of the AC switch through the chip IC1.

Lamp Starter—G

The lamp pulse starting means (block G) has an output or starting winding 28 comprising a few turns of the main winding 24 to constitute an autotransformer therewith. As a specific example, the main winding has 400 turns and the starting winding 28 has forty turns. A starting capacitor means C11 is adapted to charge upon initial connection of the operating circuit to the AC source or line and then to discharge through the starting winding 28 when a predetermined voltage level of 180 volts is achieved. The resulting autotransformer function generates a high voltage starting pulse such as 1800 volts in the main winding 24 and across the lamp 12 to initiate the discharge therein. After the lamp 12 is operating, the starting capacitor C11 is never charged to the level at which it will discharge, thereby rendering the starting circuit inoperative.

More specifically, when the capacitor voltage exceeds the Zener voltage of Z3, SCR Q302 is triggered which causes a high voltage pulse to appear across the lamp because of the autotransformer relationship of the main inductor 24, 28 (FIGS. 1 and 2). This breaks down the discharge path to start the lamp 12 and once the lamp is operating, the lamp voltage drop never exceeds the Zener breakdown voltage of Z3 so that the lamp starter mechanism is thereafter essentially removed from the circuit.

AC Switch Voltage Sensing—H

This is a voltage divider-resistor arrangement provided by resistors R306 and R307 whose function is to reduce the AC switch voltage sufficiently to ensure that no damage will occur to the IC chip.

Clock Mechanism—I

R320 and C8 provide the RC timing and the chip IC1 provides clock pulses to the binary counter of the clock mechanism, shown as a chip IC2. Such a chip is commercially available from R.C.A. under the designation CD4020AF. Other similar chips can be substituted therefor. When the binary counter counts up to $2^{14}$ pulses, the clock mechanism generates a signal which is fed back into the chip IC1 in order to cause a dimming of the lamp. When line power is removed, such as by a momentary failure, or the opening of the photo-control switch on a standard luminaire, R314 and C9 act to reset the counter back to zero so that full power cycle operation for the lamp is again initiated and continues for another four hours. This prevents random startup of the lamp and controls the functioning of the timer. The use of the binary counter as a lamp dimmer does not form a part of the present invention and such structures are described in the aforementioned copending applications Ser. No. 861,591 and Ser. No. 861,587.

For a specific identification of each of the circuit components as shown in FIG. 3, reference should be made to the following component chart identified as Table I.

TABLE I

| Comp. | Value | % Tol. | Type | Mfg. (or equiv.) |
|---|---|---|---|---|
| R301 | 1M ½W | 5 | Carbon Comp. | Ohmite |
| R302 | 100K ¼W | 5 | SBB Deposited Carbon | " |
| R303 | 1K 1W | 5 | Carbon Comp. | " |
| R304 | 240K ½W | 5 | Carbon Comp. | " |
| R305 | 25K Pot. ½W | 20 | 375 Cermet Trimmer | C.T.S. |
| R306 | 1M ½W | 5 | Carbon Comp. | Ohmite |
| R307 | 1M ½W | 5 | SBB Deposited Carbon | " |
| R308 | 56K 2W | 5 | Carbon Comp. | " |
| R309 | 2K ¼W | 5 | SBB Deposited Carbon | " |
| R310 | 100K ¼W | 5 | SBB Deposited Carbon | " |
| R311 | 2K ¼W | 5 | SBB Deposited Carbon | " |
| R312 | 750 ¼W | 5 | SBB Deposited Carbon | " |
| R313 | 120K ¼W | 5 | SBB Deposited Carbon | " |
| R314 | 1M ¼W | 5 | SBB Deposited Carbon | " |
| R315 | 750K ¼W | 5 | SBB Deposited Carbon | " |

TABLE I-continued

| Comp. | Value | % Tol. | Type | Mfg. (or equiv.) |
|---|---|---|---|---|
| R316 | 1K ¼W | 5 | SBB Deposited Carbon | " |
| R317 | 1.2K ¼W | 5 | SBB Deposited Carbon | " |
| R318 | 1K ¼W | 5 | SBB Deposited Carbon | " |
| R319 | 10K 8W | 5 | 200 Wire Wound | " |
| R320 | 1M ¼W | 5 | SBB Deposited Carbon | " |
| R321 | 1M ½W | 5 | Carbon Comp. | " |
| C1 | .01 MFD 50V | | MW50 Polyester | Paktron |
| C2 | .068 MFD 600V | | PS Tubular | Sangamo |
| C3 | 1.0 MFD 35V | | 196D Solid Tantalum | " |
| C4 | 10 MFD 15V | | 196D Solid Tantalum | " |
| C5 | 10 MFD 15V | | 196D Solid Tantalum | " |
| C6 | .047 MFD 50V | | MW50 Polyester | Paktron |
| C7 | .01 MFD 50V | | MW50 Polyester | " |
| C8 | 3.3 MFD 15V | | MW50 Polyester | " |
| C9 | 1.0 MFD 35V | | MW50 Polyester | " |
| C10 | 1.0 MFD 35V | | MW50 Polyester | " |
| C11 | 0.15 MFD 400V | | PKM Tubular | Cornell-Dubilier |
| C12 | 470 PF. 500V | | Ceramic | Cornell-Dubilier |
| D2 | | | IN457 | Texas Instrument |
| D3 | | | " | Texas Instrument |
| D4 | | | " | Texas Instrument |
| D5 | | | IN469 | Texas Instrument |
| D6 | | | " | Texas Instrument |
| D7 | | | IN457 | Texas Instrument |
| Z1 | 10 Volts | | IN961 | Texas Instrument |
| Z2 | 8.2 Volts | | IN959 | Texas Instrument |
| Z3 | 180 Volts | | IN991 | Texas Instrument |
| Q1 | | | Q6010 | Teccor |
| Q2 | | | C106B | " |
| IC2 | | | CD4020AF | R.C.A. |

General IC Chip Description

Figure 4:
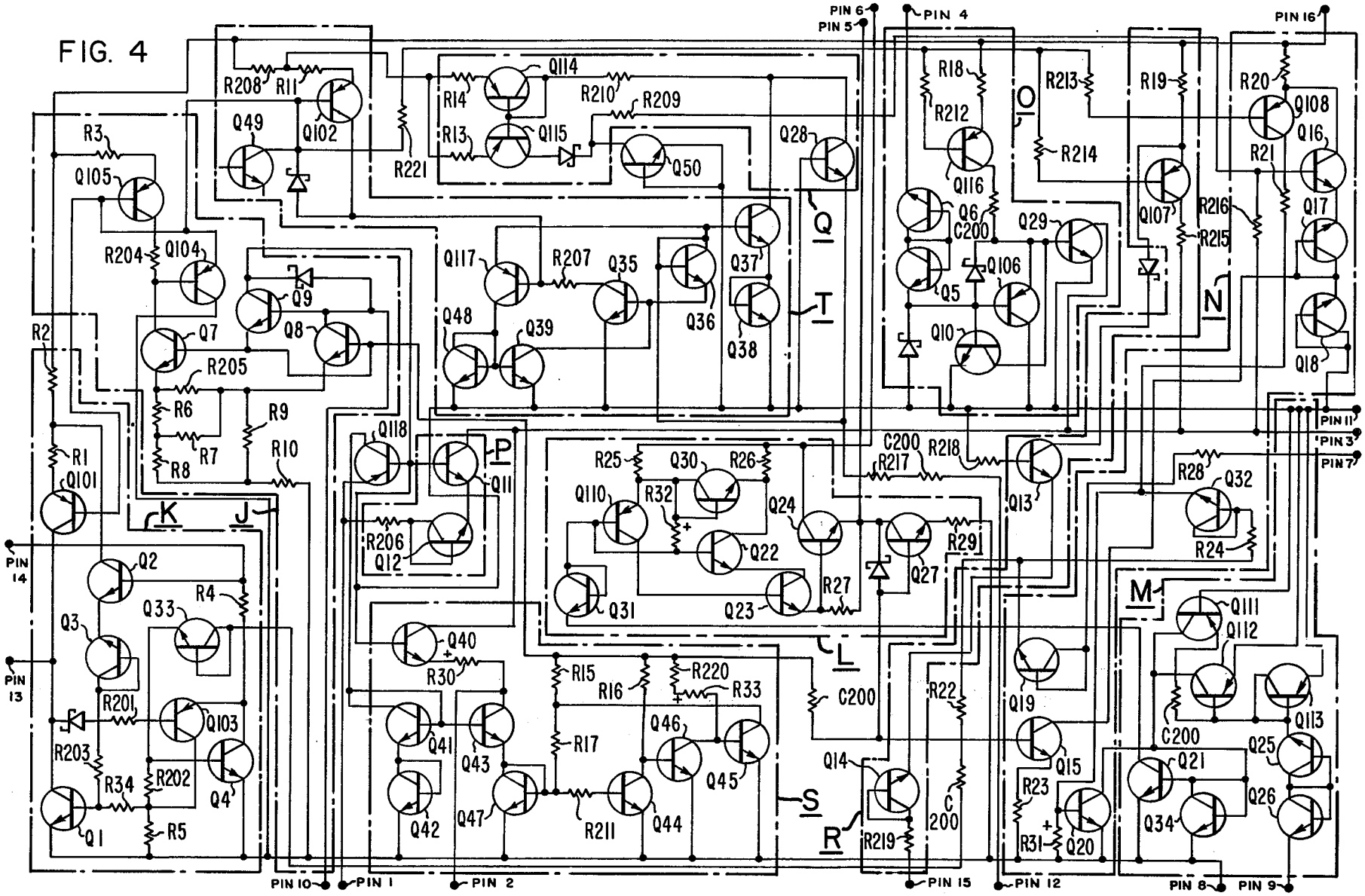
FIG. 4 is a detailed circuit diagram for the integrated circuit chip which completes the control device.

The complete circuit diagram for the custom chip IC1 is shown in FIG. 4. All of the resistors which are numbered in the 200 range are included purely for purposes of chip interconnections and serve no other circuit functions. Resistors which do serve circuit functions are numbered from R1 to R34.

Bias Current Section—J

Bias current is injected into pin 10 through R313 (FIG. 3) and develops a voltage at the base of Q7 which constitutes a bias level for a multiplicity of transistors. This bias level is one base-emitter junction drop (Q8) plus the voltage drop across R9. This current source essentially serves all NPN transistors. The current from Q7 is fed to Q105 and develops the current sources for all NPN transistors.

Timed Pulse Generator—K

C8 charges through R320 (see FIG. 3) until C8 reaches the breakdown of Q3, at which point Q2 conducts to turn on Q1, which regeneratively turns on Q4 and Q103. This discharges C8 (see FIG. 3) which pulls R4 toward the level of the negative power supply. When C8 is discharged to a level of about 2 volts, Q4 and Q103 regeneratively turn off. During the time C8 is being discharged, Q1 and Q4 are turned on and Q1 produces a low signal at pin 13 which provides the clock input pulse. When Q1 and Q4 turn off, Q101 pulls the pin 13 toward the positive power supply. The pulses are then timed by R320 and C8 to about 2 seconds. Thus the function of the timed pulse generator essentially relates to energizing the clock circuit, which need not be used and need not be included in the circuit if lamp dimming is not to be provided.

TRIAC TRIGGERING—L

The energy storage capacitor (C6 in FIG. 3) is tied to pin 5 and this is at the negative voltage level as previously described. Pin 6 is tied to the gate of the triac Q301 and when a trigger condition occurs, current is pulled through Q31 to the bases of Q110 and Q22, causing Q110, Q22, Q23, and Q24 to regeneratively turn on. This produces a very low impedance between pin 6 and pin 5 and discharges C6 to the control terminal or gate of triac Q301 (FIG. 3). Q27 which is tied to pin 5 is used to charge C6 from the negative power supply.

GATE DRIVE INHIBIT CIRCUIT—M

It is desirable to withhold any gate drive until the AC switch is in a nonconducting state and this circuit achieves that function. The voltage at pin 9 is provided by the voltage divider R306, R307 as previously described. When the current from the voltage divider R306-R307 is negative and in excess of approximately 14 volts, current flows through Q13 and Q25 in the reverse direction and through Q26, and by virtue of the base-emitter matching, Q112 carries a current equal to Q113 which flows into the base of Q34, provided a gate pulse is required at that point in time. If a gate drive is not required, Q20 is turned on and this sorts out any signals. To trigger the AC switch, the current through Q34 is mirrored by virtue of the base-emitter junctions in order to provide a signal to turn on the triac trigger which shorts pin 6 to pin 5 to discharge the capacitor C6 into the triac gate terminal to trigger same. When the AC switch voltage is positive and in excess of about 14 volts, current flows through Q26 in the reverse direction and then through Q5, then through Q111 into Q34 and the operation thereafter is as previously described.

Ramp Timing Phase Control For Triac Trigger—N

Pin 11 is at ground potential and the timing or ramp capacitor means C7 (FIG. 3) is tied from pin 11 to pin 3. Numerous internal current sources, as will be described hereinafter, are tied to pin 3 to control the charging rate of the ramp capacitor C7. Q108 is a constant current source as is Q15 with the current provided by Q15 being twice that provided by Q108. Whenever the voltage charge on Q7 is less than the Zener voltage drop of Q17, the current from Q15 flows through Q18 and to ground. When the capacitor voltage C7 equals or exceeds the Zener voltage of Q17, the current from Q15 flows through Q17 and Q16 to the emitter resistor R20 tied to Q108. Under these conditions, Q108 is non-conducting. With Q108 non-conducting, Q20 receives no base drive and is non-conducting and this permits the drive from the AC switch voltage to trigger the triac at a predetermined time. When the voltage at capacitor C7 is less than the Zener breakdown of Q17, however, Q108 is conducting and this turns on Q20 which shunts the current signal from the AC switch to ground, thereby preventing triggering of the triac Q301 (FIG. 3).

Line Voltage Zero Reset—O

The input signal to pin 4 is obtained from the RC network previously described under FIG. 3 entitled "Line Voltage Zero Reset". When this voltage is in excess of approximately 60–70 volts, current will flow through Q6 in reverse direction and through Q5 into the base of Q10. Q10 is thus turned on which shorts the bias current flow normally flowing into Q29 to ground, which turns Q29 off. In the negative direction, when the line voltage exceeds minus 60–70 volts, current flow is from ground through Q106 through Q5 in the reverse direction and through Q6 to pin 4. This causes Q106 to be turned on, again shorting the base drive to Q29 to turn same off. Whenever the line voltage is within the limits of plus or minus 60–70 volts, no current flow occurs in pin 4 which means that both Q10 and Q106 are in a non-conducting state and this permits the bias current of Q116 to flow into the base of Q29 causing it to be in a low impedance state and this resets the capacitor C7 tied to pin 3 to ground level.

Line Voltage Sensing—P

The voltage at the negative terminal of C3 (FIG. 3) is proportional to the line voltage and the voltage across R310 (FIG. 3) is equal to the voltage across C3 minus the Zener voltage drop of Q12. Therefore, the current through R310 flowing into pin 1 is proportional to the line voltage less a reference. This current then flows through Q11 and into pin 3, which causes the capacitor C7 to charge at a slower rate with increasing line voltage and at a higher rate with decreasing line voltage.

Low Lamp Voltage (Starting Condition)—Q

When the voltage at the negative terminal of C10 (FIG. 3), which is proportional to lamp voltage, is less than approximately 14 volts, all of the current flow through R315, which is proportional to the voltage across C10, flows into pin 12. This current flows through Q28 into Q114 which is mirrored by the base-emitter junction matching to current flow Q115 into pin 3. This in turn causes the capacitor C7 to charge at a higher rate as the lamp voltage increases. As a result, during lamp warmup, when the lamp voltage is very low, C7 charges at a very slow rate thereby triggering the triac Q301 (FIG. 3) at a much later time in each half cycle which minimizes lamp current during warmup. The overall effect is to limit the line current drawn by the lamp during the starting thereof to less than the line current drawn by the lamp during normal operation thereof and this is desirable from an installation and lamp performance standpoint.

High Lamp Voltage Sensing—R

After the lamp is normally operating, when the voltage at the negative terminal of C10 (FIG. 3) exceeds about 14 volts, any further increased current flows through R315 (FIG. 3) into pin 15 and the current flowing into pin 15 is proportional to the lamp voltage minus the reference voltage of Q14 which is acting as a Zener reference. This current is conducted through Q13 to the emitter of Q107 and this subtracts from the normal emitter current of Q107 with the following result: As pin 15 current increases, the current through Q107 flowing into capacitor C7 (FIG. 3) through pin 15 causes C7 to charge at a slower rate, which of course has the effect of decreasing the average current drawn by the operating lamp.

Summarizing the foregoing operation, the ramp capacitor means, C7, is in circuit with the gate of the AC switch means (Q301) and is operable to effect gating of the switch means when a predetermined voltage signal is developed across the ramp capacitor. The line voltage is sensed and there is generated a first current signal, the magnitude of which is indicative of the deviation of line voltage from nominal, with the first current signal feeding into the ramp capacitor during each half cycle of the AC line voltage. A lamp voltage sensing means measures the voltage drop across the lamp, both during lamp startup when the voltage drop thereacross is relatively small and also during normal lamp operation, and there is generated a second current signal, the magnitude of which is indicative of the deviation of operating lamp voltage from nominal, and the second current signal also feeds into the ramp capacitor C7 during each half cycle of the AC line voltage.

As described hereinbefore, the line voltage zero reset portion of the circuit resets the ramp capacitor C7 to a predetermined potential at a predetermined time in each half cycle of the AC line voltage, and the ramp capacitor is thereafter charged in the same half cycle, with the time interval in each half cycle in the AC line voltage which is required to develop an AC switch gating signal being determined by the cumulative charge delivered to the ramp capacitor C7 by the first current signal which is indicative of line voltage and the second current signal which is indicative of lamp voltage. Of course, during startup of the lamp, the second current signal which is indicative of lamp voltage has only a minimum value due to the low voltage drop across the lamp, which provides at most only a slow voltage variation in the charge on the ramp capacitor which maintains the triac Q301 open and which in turns maintains the inductor 22 in the first or high reactance mode for at least the substantial portion of each half cycle of the AC line voltage. After the lamp is normally operating with approximately nominal voltage drop thereacross, however, the predetermined capacitance of the ramp capacitor C7 coupled with the cumulative charge delivered thereto by the first current signal and the second current signal, indicative of line voltage and lamp voltage, coupled with a relatively small ratio of current passed by the variable inductor in its two operating modes provides for a stable and accurate control of wattage drawn by the normally operating lamp, with the current inputs to the ramp capacitor providing a very sensitive and accurate control which can be varied over a substantial portion of each half cycle of energizing potential.

Remaining sections of the chip IC1, which is custom designed, deal with lamp dimming such as might be used by stage lighting and form no part of the present invention. This will be briefly described hereinafter, however, so that the description will be complete.

Lamp Dimming Circuit Which Forms No Part of Present Invention—S

The squaring circuit (S) operates as follows: With a positive current flow into pin 1, Q118 conducts into Q41 and Q42 and Q41, Q42, Q43 and Q47 constitute a logarithmic multiplication circuit wherein Q47 is the constant current source. Q43 therefore produces a current which is proportional to the input current squared divided by a constant current. The resulting network, that is, that the resistor-transistor Q44, Q46, Q45 network is to produce a constant current in Q47. The current through Q43 is then conducted through Q40 and is filtered by a capacitor (not shown) tied to pin 2 and the resistor 30. A current through Q40 then flows directly into the timing capacitor C7 which of course controls the triac Q301 and thus the dimming of the lamp.

Square Rooting Circuit—T

This also is a part of the dimming circuit and when positive current flows into pin 12, it is conducted through Q117 and Q36 by the mirror circuit of Q48 and Q39 to circuit ground. Thus the current through Q36 is proportional to the current entering pin 12. The current through Q35 is a constant current produced by Q102. Q35, Q36, Q37, and Q38 form a logarithmic multiplier with the feature that the current through Q37 is equal to current through Q38, which is equal to the square root of the current through Q36 times the constant current in Q35. Thus the output current is proportional to the square root of the input current. The current through Q37 flows into Q114 and is mirrored into Q115 to pin 3 to charge the capacitor C7. In the foregoing circuit, the lamp voltage is squared to develop a signal in order to charge the timing capacitor to phase control the lamp. Squaring the lamp voltage to develop a signal provides a better control of the lamp brightness. In the square rooting circuit, the functional effect is to provide what essentially is a linear relationship between control voltage and light output. Thus the present dimming circuit enables two types of control to be achieved, namely, a linear light relationship which is valuable for use with cameras and an apparent light relationship which can be used in stage lighting for human response.

General Design Considerations

As a general comment, it is desirable to minimize the size of the lamp ballast inductor from an expense standpoint and to provide an inductor with as little voltage drop across it as possible, commensurate with reasonable regulation. With a large change in inductance in the inductor, lamp starting currents tend to be excessive and to minimize lamp starting currents, it is highly desirable to limit the changes in inductance to a relatively small ratio, i.e., less than 2:1. This in turn requires a very large phase shift control, especially where high pressure sodium lamps are involved, to adequately control the power into the lamp throughout its life where increases in lamp voltages with life can normally be anticipated. The present circuit achieves these objectives.

To complete the description of the custom chip IC1, shown in FIG. 4, precise values for all components thereof are set forth in the following Table II.

TABLE II

| Component | Value |
|---|---|
| R1 | 3.15K |
| R2 | 450Ω |
| R3 | 2.7K |
| R4 | 1.35K |
| R5 | 3.6K |
| R6 | 450Ω |
| R7 | 3.6K |
| R8 | 900Ω |
| R9 | 1.8K |
| R10 | 450Ω |
| R11 | 3.6K |
| R13 | 3.6K |
| R14 | 3.6K |
| R15 | 1.3K |
| R16 | 3.6K |
| R17 | 1.8K |
| R18 | 4.95K |
| R19 | 3.6K |
| R20 | 4.05K |
| R21 | 450Ω |
| R22 | 7.9K |
| R23 | 1.8K |
| R24 | 6.75K |
| R25 | 10.4K |
| R26 | 900Ω |
| R27 | 3.6K |
| R28 | 3.15K |
| R29 | 1.35K |
| R30 | 30K (Pinch) |
| R31 | 130K (Pinch) |
| R32 | 130K (Pinch) |
| R33 | 30K (Pinch) |
| R34 | 1.35K |
| C200 | (connection resistors) |
| R201 | 1.35K |
| R202 | 1.8K |
| R203 | 900Ω |
| R204 | 3.6K |
| R205 | 900Ω |
| R206 | 450Ω |
| R207 | 200Ω |
| R208 | 400Ω |
| R209 | 2.7K |
| R210 | 1.8K |
| R211 | 1.35K |
| R212 | 200Ω |
| R213 | 200Ω |
| R214 | 1.35K |
| R215 | 3.6K |
| R216 | 450Ω |
| R217 | 5.4K |
| R218 | 1.8K |
| R219 | 400Ω |
| R220 | 3.6K |
| R221 | 700Ω |

R(C and 201-221) resistors are included in chip to facilitate fabrication and not for circuit operation.
Schottky diodes are rated at 100 microamps forward currrent, 20V blocking.
All transitors rated at 20V collector-emitter breakdown.
Large NPN (Q5, Q24) rated at 200 ma; other NPN (1-50 series) rated at 20 ma; PNP (100 series) rated at 2 ma.

We claim:

1. In combination, an operating circuit for controlling at about a predetermined nominal rated value the wattage drawn by a high-intensity-discharge lamp means during normal operation thereof and for limiting the line current drawn by said lamp means during starting thereof to less than the line current drawn by said lamp means during normal operation thereof, and said lamp means having lamp terminals and a nominal rated operating voltage and current, said circuit comprising:

a. input terminals adapted to be connected to an AC line voltage source having a predetermined nominal rating, and output terminals adapted to be connected to the terminals of said lamp means;

b. current controlling means in circuit intermediate said input terminals and said output terminals, said current controlling means having a first operating mode in which a current less than said lamp means nominal operating current is passed to said output terminals and through said lamp means as connected thereacross, said current controlling means also having a second operating mode in which a current greater than said lamp means nominal operating current is passed to said output terminals and through said lamp means as connected thereacross, and the ratio of the magnitude of current passed to said output terminals and said lamp means in said second mode to the magnitude of current passed to said output terminals and said lamp means in said first mode being less than 2:1;

c. switch means operable to switch said current controlling means between said two operating modes thereof during each half cycle of said AC line voltage, said switch means comprising a gate-controlled AC switch, and ramp capacitor means of predetermined rating in circuit with the gate of said AC switch means and operable to effect the gating of said AC switch means when a predetermined voltage signal is developed across said ramp capacitor means;

d. line voltage sensing means for measuring the magnitude of said AC line voltage and generating a first current signal the magnitude of which is indicative of the deviation of line voltage from nominal, and said first current signal feeding into said ramp capacitor means during each half cycle of said AC line voltage;

e. lamp voltage sensing means for measuring the voltage drop across said lamp means both during lamp startup when the voltage drop thereacross is relatively small and also during normal lamp operation and generating a second current signal the magnitude of which is indicative of the deviation of operating lamp voltage from nominal, and said second current signal also feeding into said ramp capacitor means during each half cycle of said AC line voltage;

f. means for discharging said ramp capacitor means to a predetermined potential at a predetermined time in each half cycle of said AC line voltage, and said ramp capacitor means thereafter being charged in the same half cycle, with the time interval in each half cycle of said AC line voltage which is required to develop said AC switch gating signal being determined by the cumulative charge delivered thereto by said first current signal and said second current signal; and g. during startup of said lamp means, said second current signal having minimal value due to the low voltage drop across said lamp means to provide at most only a slow voltage variation in the charge on said ramp capacitor means and to maintain said current controlling means in said first mode for at least the substantial portion of each half cycle of said AC line voltage, and after said lamp means is operating normally with approximately nominal voltage drop thereacross, the predetermined capacitance of said ramp capacitor means coupled with the cumulative charge delivered thereto by said first current signal and said second current signal coupled with the relatively small ratio of current passed by said current controlling means in said second mode to current passed by said current controlling means in said first mode providing a stable and accurate control of wattage drawn by said normally operating lamp means.

2. The combination as specified in claim 1, wherein said lamp means comprises high-intensity-discharge sodium lamp means, and power factor capacitor means of predetermined rating is connected in circuit with said operating circuit.

3. The combination as specified in claim 2, wherein said current controlling means comprises a variable inductor in series with said AC source and said lamp means, said switch means is electrically connected in series with a control winding on said variable inductor, said switch means when closed causing a current to flow in said control winding on said variable inductor to decrease the reactance thereof and place same in said second operating mode, and said switch means when open preventing current flow in said control winding on said variable inductor to increase the reactance thereof and place same in said first operating mode.

4. The combination as specified in claim 3, wherein said variable inductor includes a main winding, lamp pulse starting means having an output winding comprising a few turns of said main winding to constitute an autotransformer, starting capacitor means included as a part of said lamp starting means and adapted to charge upon initial connection of said operating circuit to said AC source and then to discharge through the output of said lamp starting means when a predetermined voltage level is achieved across said starting capacitor means, with the resulting autotransformer function generating a high voltage starting pulse in said main winding and across said lamp means to initiate a discharge therein, and after said lamp is operating, said starting capacitor means is not charged to the predetermined voltage level at which it will discharge thereby to render said lamp starting means inoperative.

* * * * *